US008800836B2

(12) United States Patent
Scott et al.

(10) Patent No.: US 8,800,836 B2
(45) Date of Patent: Aug. 12, 2014

(54) TOOL FOR APPLYING INSULATION FASTENERS

(75) Inventors: Lachlan James Scott, Victoria (AU); Ian Ross Ferrier, Victoria (AU); David McCullough, Victoria (AD)

(73) Assignee: ITW Construction Systems Australia Pty Ltd, Victoria (AU)

( * ) Notice: Subject to any disclaimer, the term of this patent is extended or adjusted under 35 U.S.C. 154(b) by 560 days.

(21) Appl. No.: 13/129,069

(22) PCT Filed: Nov. 24, 2009

(86) PCT No.: PCT/IB2009/055321

§ 371 (c)(1), (2), (4) Date: May 12, 2011

(87) PCT Pub. No.: WO2010/061336

PCT Pub. Date: Jun. 3, 2010

(65) Prior Publication Data

US 2011/0226834 A1 Sep. 22, 2011

(30) Foreign Application Priority Data

Nov. 25, 2008 (AU) ..... 2008906096

(51) Int. Cl.
*B21J 15/28* (2006.01)

(52) U.S. Cl.
USPC ..... 227/8; 227/10; 227/139; 227/119; 227/140; 227/147; 411/441; 411/480

(58) Field of Classification Search
USPC ..... 227/8, 10, 139, 119, 140, 147; 411/441, 411/480
See application file for complete search history.

(56) References Cited

U.S. PATENT DOCUMENTS

| | | | | |
|---|---|---|---|---|
| 2,930,041 A | | 3/1960 | Massacrier | |
| 3,203,609 A | * | 8/1965 | Diehl | 227/8 |
| 3,399,817 A | * | 9/1968 | Diehl | 227/10 |
| 3,423,001 A | | 1/1969 | Bell | |
| 3,854,536 A | | 12/1974 | Hallock, Jr. | |
| 4,077,556 A | | 3/1978 | Buchel | |
| 4,189,081 A | | 2/1980 | Combette et al. | |
| 5,611,474 A | * | 3/1997 | Schmidle et al. | 227/10 |

FOREIGN PATENT DOCUMENTS

| | | |
|---|---|---|
| CN | 1099325 A | 3/1995 |
| CN | 1104703 A | 7/1995 |
| DE | 19755730 A1 | 6/1999 |

OTHER PUBLICATIONS

ISR for PCT/IB2009/055321 dated Mar. 29, 2010.

* cited by examiner

*Primary Examiner* — Michelle Lopez
(74) *Attorney, Agent, or Firm* — Lowe Hauptman & Ham LLC

(57) ABSTRACT

A tool for driving a fastener pin into a substrate to secure a fastener body to the substrate for fixing insulation or other cladding, the tool being of the type comprising a fastener guide and a driving piston driven along the fastener guide by gas pressure to engage and drive the pin, the fastener guide being displaceable axially inwardly relative to the body of the tool in order to cock the tool for firing of the driving piston, wherein the tool comprises means for enabling the tool to push the fastener body through insulation or other cladding into engagement with the underlying substrate without putting the tool into a condition in which firing can occur, the tool being thereafter able to be put into a condition to permit firing to take place.

25 Claims, 11 Drawing Sheets

TOOL FOR APPLYING INSULATION FASTENERS

RELATED APPLICATIONS

The present application is national phase of PCT/IB2009/055321 filed Nov. 24, 2009, and claims priority from Australian Application Number 2008906096, filed Nov. 25, 2009.

The present invention relates to a tool for applying fasteners to a substrate to fix insulation thereto.

Insulation (thermal or acoustic) for use in building construction can be applied to an underlying substrate in a variety of ways determined by such factors as the particular usage, the type of insulation, and the type of substrate. Current practice in commercial building construction is for insulation batts or panels to be applied to a hard substrate such as a concrete wall panel or at the underside of a floor slab by means of purpose-designed fasteners using a powder actuated (p.a.) tool to drive a pin of the fastener into the hard substrate. The insulation is of various types and densities, including polystyrene (expanded and extruded), polyester, fibreglass, and mineral wool. P.a. tools use the power of an explosive charge which is sufficient to drive a fastener pin into a hard substrate such as a concrete structure or a steel beam. Current fasteners for applying insulation using a p.a. tool incorporate a fastener pin which is of a size to withstand the high forces generated by conventional p.a. tools. This compromises the overall design of the fastener and in practice it can be quite difficult to push the fastener body through batts of medium and hard density prior to firing the tool in order to drive the fastener pin into the substrate to retain the fastener thereto. Moreover, the use of the p.a. tool itself in this fastening situation gives rise to operational difficulties. P.a. tools are subject to quite substantial recoil on firing and particularly in a situation when an operator is working from below when fixing batts to the underside of a ceiling, it can be very tiring for the operator to absorb the recoil.

In practice, the body of the fastener is mounted on a fastener guide at the forward end of the tool and the tool is used to push the fastener body through the insulation until its end engages the substrate at which point the tool is fired to drive the fastener pin into the substrate. A safety mechanism built into p.a. tools requires the tool to be cocked prior to firing by pushing the forward end of the fastener guide against the component into which the fastener pin is to be fired whereby the fastener guide retracts into the body of the tool against a strong spring bias; firing cannot take place until that action has occurred. However in a situation where the tool is used to force the fastener body through the insulation using manual pressure applied by the operator, depending on the structure of the insulation itself, this may generate sufficient resistance as to cause a loading sufficient to displace the fastener guide rearwardly and thereby cock the tool ready for firing before the fastener body has been pushed fully through the insulation and into engagement with the underlying substrate.

In our co-pending application entitled "Fastener for insulation", there is proposed an insulation fastener designed for use with tools for driving a fastening pin of smaller size, such as gas or air tools or p.a. tools modified for that purpose. Gas and air tools operate on a similar principle to p.a. tools by powering a driving piston along a barrel and fastener guide to engage a pin type fastener at the end of the guide. In a p.a. tool the piston is driven by firing of an explosive charge, whereas in a gas powered tool the piston is driven by explosive combustion of a gas, for example propane and/or butane, and in an air powered tool, the piston is driven by rapid expansion of compressed air from a compressed air source. However, gas powered and air powered tools require a cocking action similar to that described above in connection with p.a. tools, but the cocking force (the force required for displacement of the fastener guide into the tool body) is generally less. As a consequence of the reduced cocking force, there will be an increased tendency for the tool to cock prematurely under the loading which can arise as the fastener is forced through the insulation.

Although with all forms of tool of the type discussed, p.a., gas, or air, premature cocking is undesirable as it does permit the tool to be fired prematurely which means that the pin might not drive into the substrate or at least not properly drive into the substrate, a particular problem can arise with gas powered tools in which cocking the tool also initiates a timed combustion cycle for the gas; if the tool is not then fired within a predetermined time, usually about two seconds, the tool will not actuate, unburnt gas will be discharged, and the tool will need to be reset for further operation.

The present invention relates to a fastener driving tool of the type discussed (p.a., gas, or air), having means to prevent cocking of the tool during the action of forcing the fastener body through the insulation.

According to the invention, there is provided a tool for driving a fastener pin into a substrate to secure a fastener body to the substrate for fixing insulation or other cladding, the tool being of the type comprising a fastener guide and a driving piston driven along the fastener guide by gas pressure to engage and drive the pin, the fastener guide being displaceable axially inwardly relative to the body of the tool in order to cock the tool for firing of the driving piston, wherein the tool comprises means for enabling the tool to push the fastener body through insulation or other cladding into engagement with the underlying substrate without putting the tool into a condition in which firing can occur, the tool being thereafter able to be put into a condition to permit firing to take place.

In one embodiment, the means for enabling the tool to push the fastener body through the insulation or other cladding without putting the tool into a condition in which firing can occur comprises a releasable lock for preventing cocking of the tool during that action.

In another embodiment, the tool is a gas tool having control circuitry operable to initiate the gas combustion process in response to inwards displacement of the fastener guide, the circuitry being inoperative to initiate the combustion process during a first relative inwards displacement of the fastener guide occurring while pushing the fastener body into engagement with the underlying substrate, the circuitry being then operative to initiate the combustion process in response to a second relative inwards displacement of the fastener guide.

Advantageously, the tool is operable to be put into a condition in which firing can occur following engagement of the fastener body with the underlying substrate, by releasing axial load applied by an operator to the tool body to push the fastener body through the insulation or other cladding and then re-applying the axial load to the tool body whereby to cause cocking of the tool.

Further according to the present invention there is provided a tool for driving a fastener pin into a substrate to secure a fastener body to the substrate for fixing insulation or other cladding, the tool being of the type comprising a fastener guide and a driving piston driven along the fastener guide by gas pressure to engage and drive the fastener, the fastener guide being displaceable axially inwardly relative to the body of the tool in order to cock the tool for firing of the driving piston, wherein the tool comprises means for locking the fastener guide against axial displacement relative to the tool body sufficient to prevent cocking to thereby permit the tool to push the fastener body through insulation or other cladding into engagement with the underlying substrate without cocking the tool, the lock being thereafter releasable to permit cocking to take place.

In one embodiment of the invention, release of the lock against axial displacement occurs in response to release of axial load applied by an operator to the tool to push the fastener through the insulation or other cladding whereby when axial load is next applied this will have the effect of cocking the tool. Alternatively, the lock against axial displacement can be released by rotation of the tool relative to the fastener guide by the operator after insertion of the fastener through the insulation or other cladding. In further alternatives, other operator-controlled mechanisms can be used to provide the selective locking/unlocking effect.

In particularly preferred embodiments, the fastener guide is associated with a cam system which causes selective locking and release in different angular positions. Advantageously the cam system comprises a rotatable cam body carried by the fastener guide and having cam tracks which co-operate with a fixed cam member whereby the cam is successively indexed to locking and release positions for the fastener guide in response to manual force applied to the tool body by the operator.

Advantageously, the selective locking system defined above can be incorporated into certain existing designs of tool by providing an attachment in the form of a replacement fastener guide and associated locking system mounted to the forward end of the tool body in place of an existing fastener guide. Existing designs of tool can be converted for use specifically for use with insulation fasteners with this improved functioning without the need to design and build special tools for this purpose.

An embodiment of the invention will now be described by way of example only with reference to the accompanying drawings in which.

Figure 1:
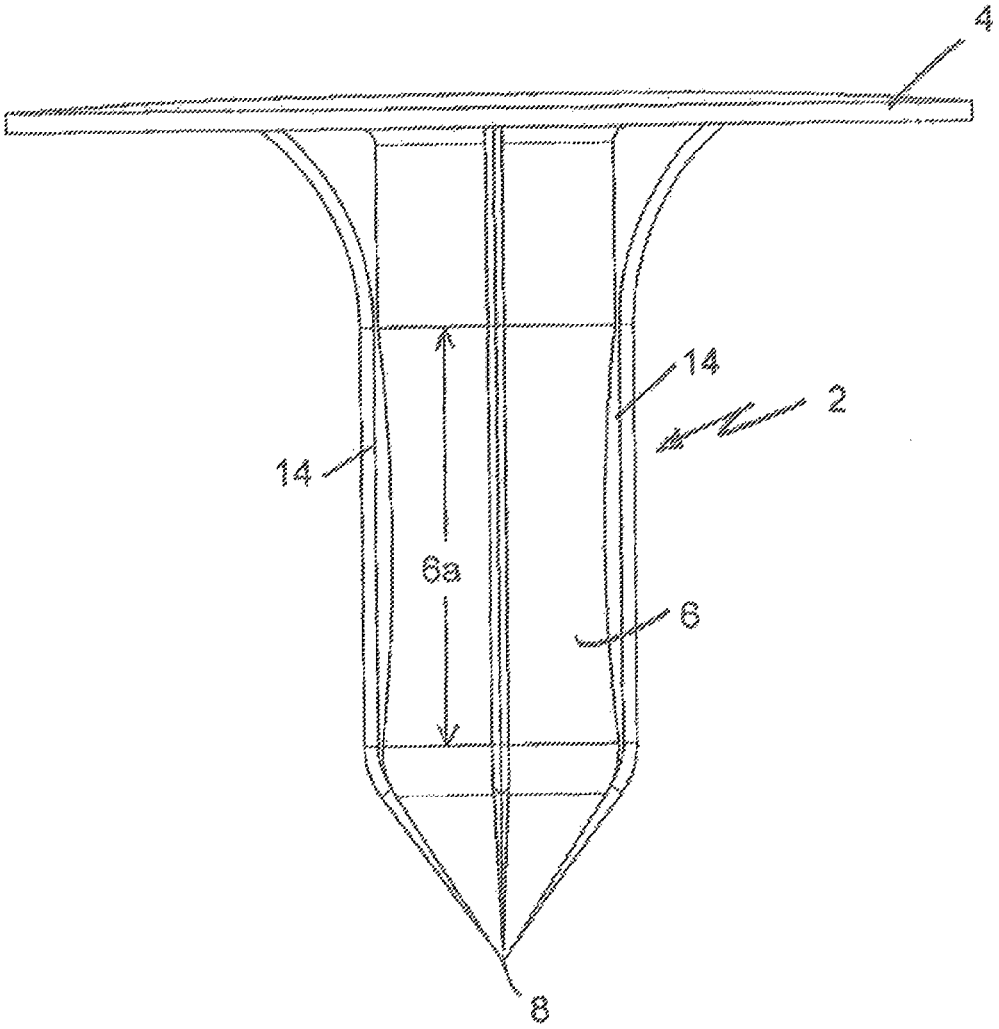
FIG. 1 is a side view of an insulation fastener of the general type with which a tool in accordance with the preferred embodiment can be used.
Figure 2:
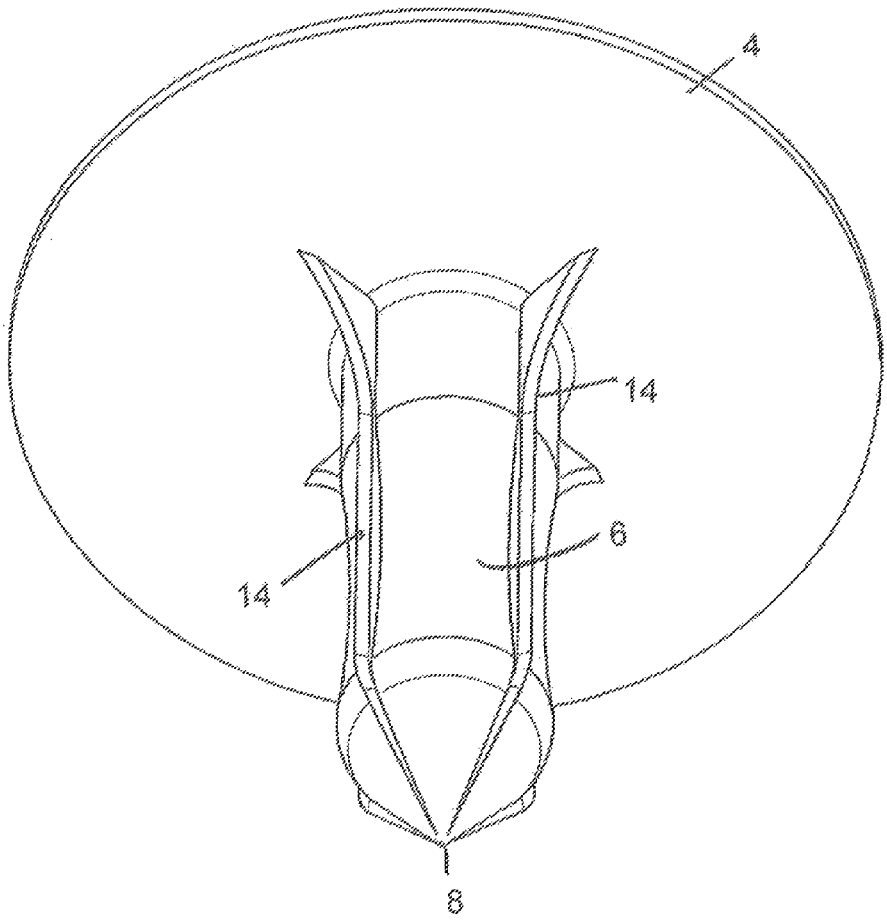
FIG. 2 is a perspective view of a fastener from underneath.
Figure 3:
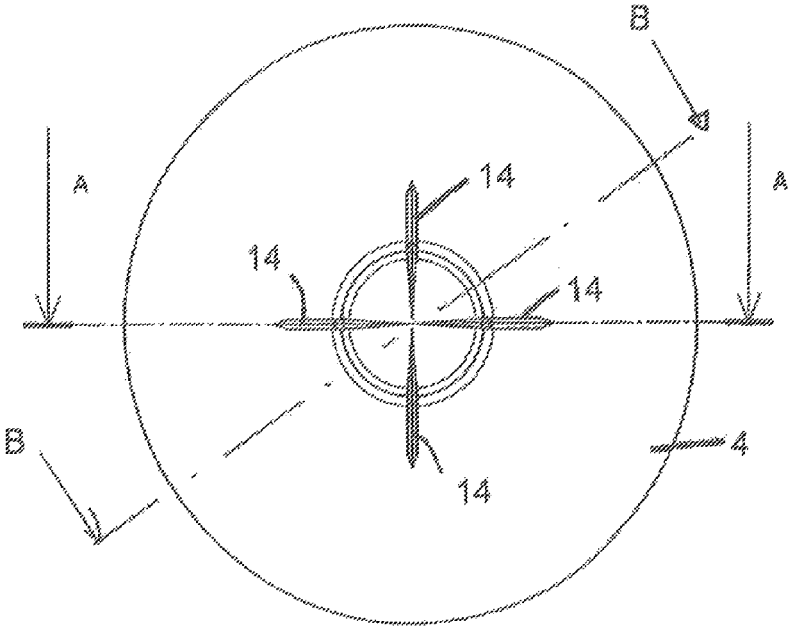
FIG. 3 is an end view of the fastener.

The fastener shown in FIGS. 1 to 5 is the subject of our co-pending application referred to previously and a detailed description is included here to assist a better understanding of the operation of the fastener applying tool of the preferred embodiment.

The fastener for thermal and/or acoustic insulation bans, panels, or cladding in accordance with the preferred embodiment of the invention comprises a body 2 formed in one piece from a moulded plastics, for example polypropylene. The body comprises at its outer end (the end adapted to lie adjacent to the exposed face of the insulation) a large area disc-like head 4 having a generally planar inner face to engage the exposed face of the insulation. A tubular stem 6 extends inwardly from the inner face of the head 4 and narrows at its inner end portion to a sharp point 8. The inner end portion of the stem 6 is configured internally to receive and retain a fastener pin 10 (shown in outline in FIG. 4). The pointed end of the pin 10 is enclosed wholly within the structure of the inner end portion of the stem 6 and lies closely adjacent to the pointed end 8 of the stem.

The fastener of the preferred embodiment is of design for use with a gas powered or air powered tool which operates by powering a driving piston along a barrel and associated fastener guide to drive a fastener pin at the end of the fastener guide. In a gas powered tool, the piston is driven by explosive combustion of a gas, for example propane and/or butane, and in an air powered tool, the piston is driven by rapid expansion of compressed air from a compressed air source. The fastener pin 10 in the fastener of the preferred embodiment is of a size sufficient to withstand the driving forces either in a gas powered or air powered tool. These forces are generally less than those generated in a conventional p.a. tool and tend to be more controllable, and therefore the pin 10 can be of reduced size/strength in relation to those employed in current insulation fasteners designed for use with p.a. tools. However the fastener may also be used with a p.a. tool modified for the purpose as will be described later.

Figure 4:
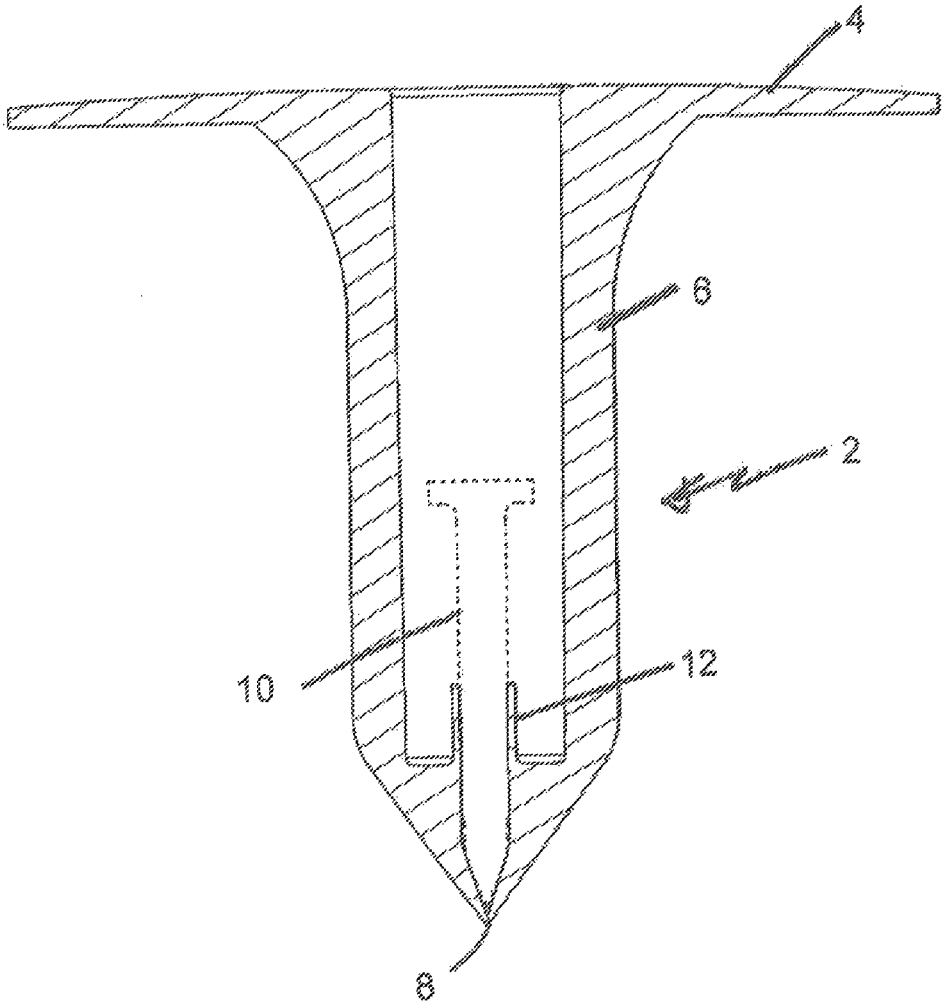
FIG. 4 is a section taken on line A-A of FIG. 3.
Figure 5:
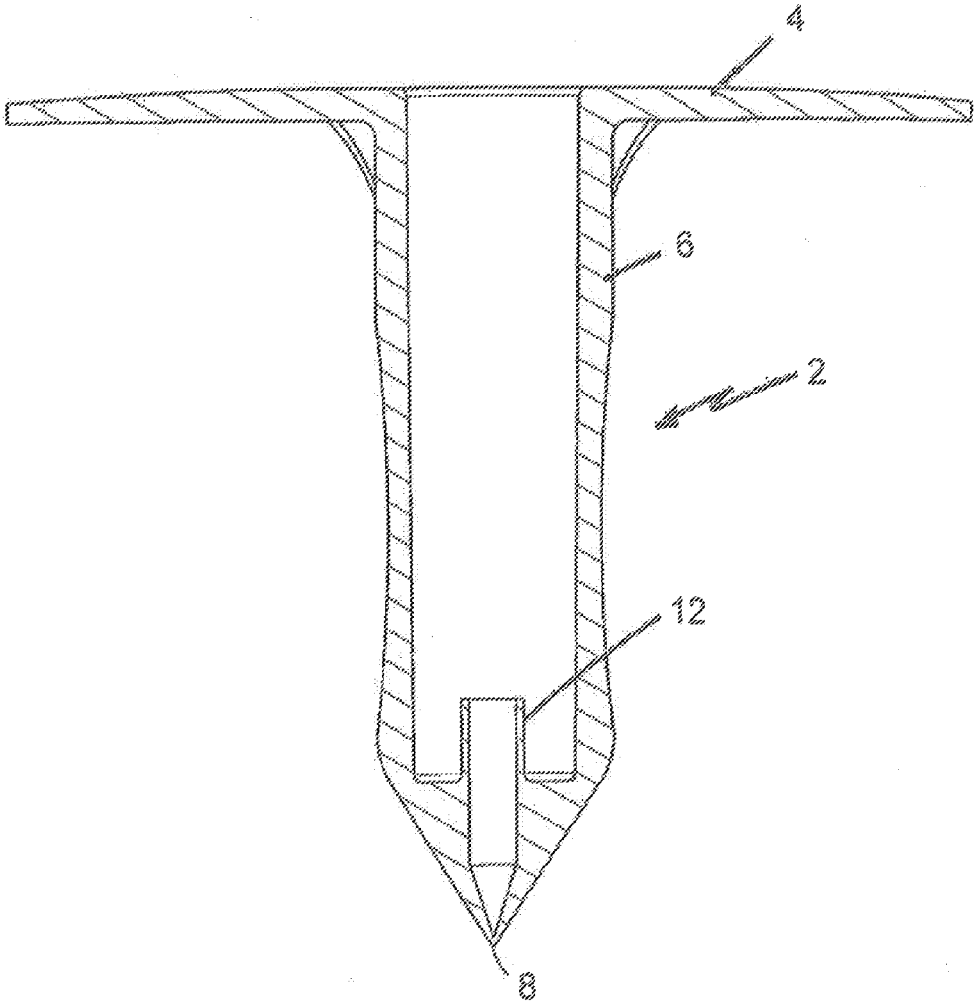
FIG. 5 is a section taken on line B-B of FIG. 3.

It will be seen from FIGS. 4 and 5 that the pointed inner end portion of the stem 6 is substantially solid apart from penetration by the passage in which the pin 10 is located to provide a thick body of plastics material. A tubular spigot 12 projects outwardly from that solid end portion and, when the pin 10 is in position within the stem 6 of the body 2, the spigot 12 lies inwardly of the head of the pin. In use, the fastener body 2 with the pin 10 fitted within the stem 6 is applied to the fastener guide of the tool by inserting the stem 6 over the front end portion of the fastener guide with the tubular spigot 12 and pin head being sized to be received within the fastener guide. To facilitate retention of the fastener body 2 to the fastener guide, the interior of the stem 6 may include an array(s) of fins, ribs, or other projections to frictionally grip the external surface of the fastener guide, or an array of flexible gripping fingers may be incorporated for that purpose within the head 4 at the entrance to the stem 6. When gripping fingers are used they will lie at the entrance to the stem and this will facilitate the subsequent application of render over the outer face of the insulation. Alternatively closure caps can be inserted into the outer end of the stem for this purpose; such caps may be integrally formed with head 4 to pivot into engagement in the end of the stem after removal of the applying tool. With the fastener thus applied to the tool, the stem 6 can be pushed through the insulation using manual pressure applied by the operator via the tool. The configuration of the pointed end portion of the stem ensures that it can easily be pushed through the insulation, even insulation composed of a relatively high density material. In this regard it should be noted that the inner end portion of the stem is sharply pointed and progressively widens outwardly without providing any flattened or stepped areas which could act to provide an impediment to penetration. Also the fact that the pointed end of the pin itself is fully enclosed within the closed end portion of the stem rather than projecting through the end, means there is no external transition between the pin and stem to form a surface which may impede penetration.

The external surface of the stem 6 is formed with an array of fins 14 which commence closely adjacent to the pointed end 8 and extend longitudinally along the length of the stem. The fins 14 progressively rise from zero height adjacent the pointed end 8 and over the main body of the stem 6 their radially outer edges lie on an imaginary cylindrical surface of constant diameter throughout the major part of their length (see FIGS. 1 and 4), the fins 14 widening outwardly adjacent the head 4 for reinforcement of the transition between the stem 6 and the head 4. As shown there are four such fins uniformly placed around the stem 6 but there could be less than four such fins, three for example or more than four fins, five for example. The fins 14 perform an important role in the penetration of the stem 6 into the insulation in conjunction with the pointed end 8 as they ensure that during penetration of the stem, the material of the insulation is displaced uniformly around the stem whereby the stem 6 tends to remain straight and therefore "on line" rather than inclining as can arise from non-uniform displacement of the insulation material, particularly when the material is relatively dense.

The main body of the stem may be of constant outer diameter beyond its pointed tip portion, but it is preferred that the main body is slightly concave in an intermediate zone between its tip portion and outer end portion and this concavity is clearly visible in FIGS. 1 and 5, the concave zone being designated 6*a* in FIG. 1. The effect of concavity is to reduce the friction exerted between the stem 6 and insulation, particularly relatively dense insulation, during insertion of the stem 6. However, the slight concavity within the zone 6*a* does not impair the guidance and retention of the stem during penetration as guidance will be ensured by the presence of the fins 14 which, together with the zones of maximum diameter at either side of the zone 6*a*, will ensure retention and alignment in the insulation prior to firing of the tool.

The length of the stem 6 corresponds to the thickness of the insulation so that when the stem has fully inserted through the insulation with its pointed tip 8 in engagement with the underlying substrate, its head 4 will be in firm contact with the outer face of the insulation. It will be understood from this that, in practice, insulation fasteners in accordance with the preferred embodiment will be produced in a range of sizes, with stems of different length corresponding to different standard thicknesses of insulation.

With the insulation fastener in position in the insulation with its stem having fully penetrated the insulation into engagement with the underlying substrate, the tool (to which the fastener is still attached) can be cocked by the operator applying further forwards pressure to displace the body of the tool relative to the fastener guide. After cocking the tool can be fired so that the pin 10 drives into the substrate so as to anchor the fastener. It is to be noted that during driving of the pin 10, its head will collapse the internal tubular spigot 12 and this will act as a shock absorbing function as firing takes place.

Although the fastener has been described in relation to the fastening of thermal and/or acoustic insulation to the underlying substrate, it can also be used for fastening other cladding, particularly in the nature of a cellular or expanded foam, which requires the fastener to penetrate through its thickness before driving the fastener pin into the substrate. It is also to be understood that the underlying substrate is not necessarily of a hard nature, such as concrete; the substrate could be of a softer material, wood for example as in a wooden wall frame.

Although it is envisaged that the insulation fastener will primarily be used with gas or air tools which are designed for use with smaller fastener pins than conventional p.a. tools, it is also possible that the fastener could be used with a p.a. tool modified to incorporate a reduced diameter fastener guide and driving piston to accommodate the smaller pins, with the output power being reduced by means of a power control and/or the use of an explosive charge of reduced power.

Having described an insulation fastener with which a tool in accordance with a preferred embodiment of the invention can be used for application of the fastener, the tool itself will now be described.

The basic construction of the tool itself irrespective of whether it is a p.a. tool, a gas tool or air tool is substantially conventional and will be well understood by those skilled in the art and therefore a detailed description is not required here. The differences over conventional tools reside in the incorporation of a fastener guide modified to incorporate a locking system to prevent cocking of the tool by displacement between the fastener guide and tool body during penetration of the stem of the fastener through the insulation batt. Advantageously the modification is achieved by way of an attachment mounted to the forward end of existing tools of this type so that existing designs of tool can be modified specifically for this particular usage. Essentially, the attachment provides a replacement fastener guide and associated locking system. Although the modification is such that it is more likely to be undertaken by the manufacturer or supplier of the tool, nevertheless the attachment could be provided as an accessory for incorporation by the user. However, the modification by use of the attachment does mean that a tool manufacturer does not need to build completely different tools for this purpose.

Figure 6:
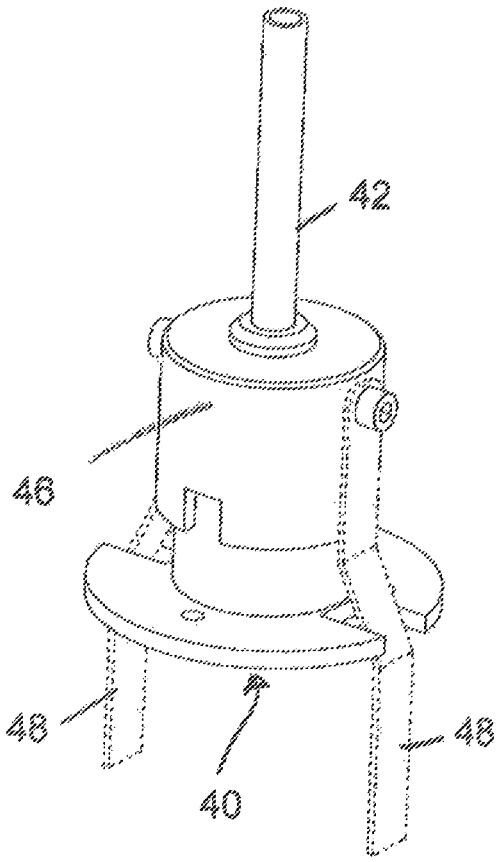
FIG. 6 shows an assembly comprising a fastener guide and associated cam controlled locking system for a tool in accordance with a preferred embodiment of the invention.
Figure 7:
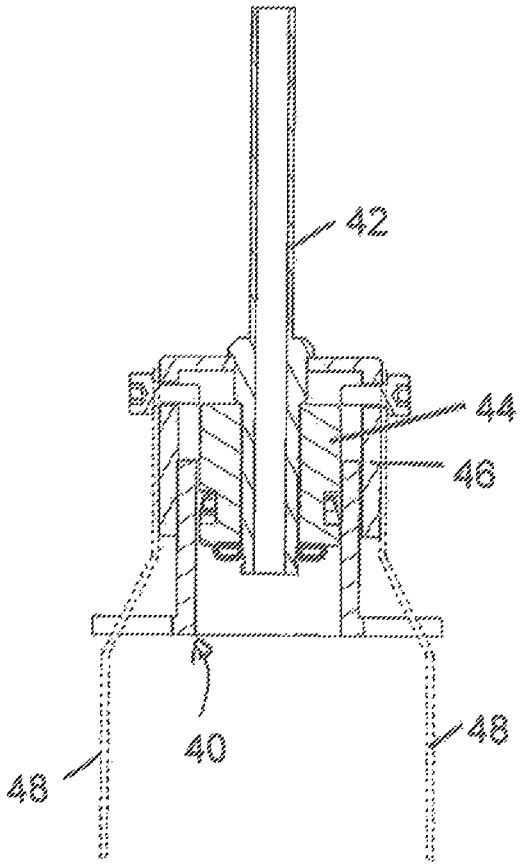
FIG. 7 is a section through the assembly of FIG. 6.

With initial reference to FIGS. 6 and 7, the attachment comprises a fixed housing 40 adapted to be bolted to the tool body at the front end thereof. The housing 40 is principally of cylindrical form with an annular mounting flange for bolting to the tool body. The fastener guide 42 is mounted for axial movement within the housing 40 by means of a cylindrical cam body 44 at its rearward end. The cam body 44 is mounted to the fastener guide 42 for axial movement therewith and the co-operation between the cam body and internal surface of the housing 40 guides the cam body and fastener guide for such axial movement. The cam body 44 is also mounted for controlled rotational movement within the housing 40 about the axis thereof. In the particular embodiment shown, the cam body 44 is rotatably mounted on the fastener guide 42 so that it can rotate relative to the fastener guide, but in other forms the cam body may be rigidly mounted on the fastener guide so that when the cam body rotates the fastener guide will also rotate. An outer cap 46 is slidably mounted on the external surface of the housing 40. The cap 46 is coupled to the fastener guide 42 and by its co-operation with the housing 40 encloses the cam body 44 from the front. The cap 46 is also coupled to a pair of spring arms 48 which form part of the basic structure of the tool. The arms 48 are mounted in the tool for axial movement and are linked to the firing mechanism of the tool. The arms 48 are subject to a forward spring bias and cocking of the tool takes place when the arms are displaced rearwardly relative to the tool body against that bias and, as will be appreciated, by virtue of the coupling to the fastener guide 42 such rearwards displacement takes place by rearwards displacement of a fastener guide itself in the manner previously explained.

In the version shown in FIGS. 6 and 7, rearwards displacement of the fastener guide to effect cocking also brings the rear end of the fastener guide into engagement with a fixed barrel-like component at the forward end of the tool. When the tool is fired, the drive piston will be propelled into the fastener guide to engage the head of the fastener pin within the forward end of the fastener guide.

In other versions, the barrel itself may be mounted for axial displacement within the tool and subject to a forward spring bias, with cocking taking place by rearwards displacement of the barrel. In that case the forward end of the barrel will co-operate with the rear end of the fastener guide to provide the forward spring bias to the fastener guide.

The detailed structure of the cylindrical cam body 44 and its co-operation with the fixed housing 40 will now be described in detail with reference to the FIGS. 8 to 11. In these figures, the outer cap 46 and spring arms 48 have been omitted for the purposes of clarity.

The cylindrical cam body 44 has upper and lower peripheral cam tracks 50, 52 and axial cam tracks 54 extending from the upper cam track 50. The housing 40 carries a series of fixed cam pins 56 evenly spaced around its axis for co-operation with the cam tracks 50, 52, 54 in a manner to be described to provide an indexed, stepwise, rotation of the cam body. The co-operation between the cam pins and the cam tracks provides for controlled locking of the cam body 44 and thus of the fastener guide 42 against axial movement and for controlled release of such locking. The use of several cam pins 56 evenly distributed around the housing 40 ensures balanced operation of the cam body 44 but as the cam pins each co-operate with the adjacent portion of the cam tracks in the same way, the interaction between just one of the cam pins and its associated portion of the cam tracks will be described in the following.

Figure 8:
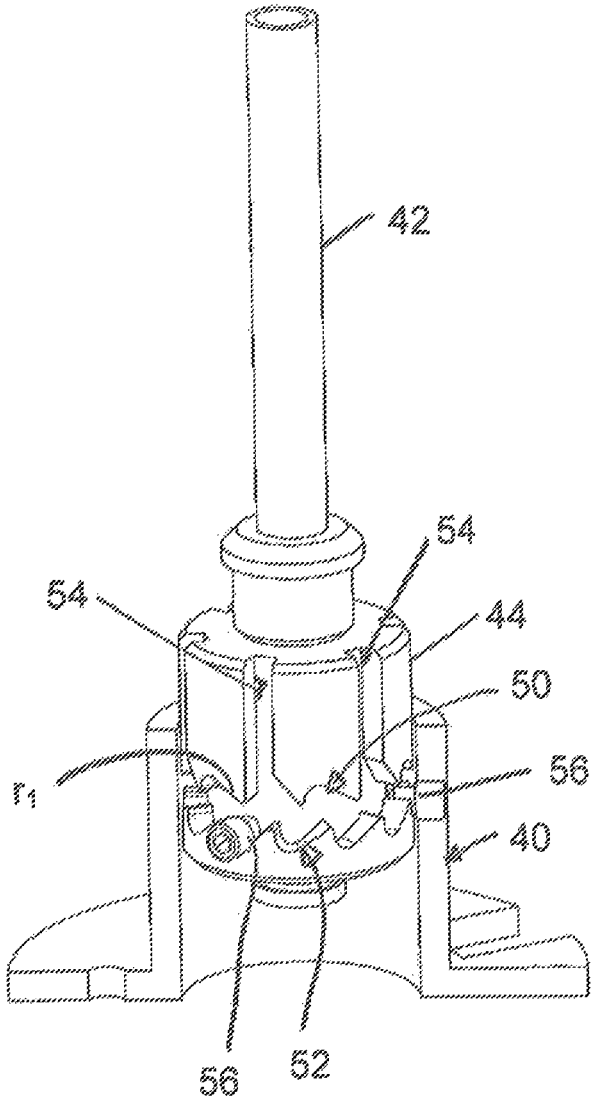
FIGS. 8 to 11 are schematic views showing the assembly during different phases in the operation of the tool.
Figure 9:
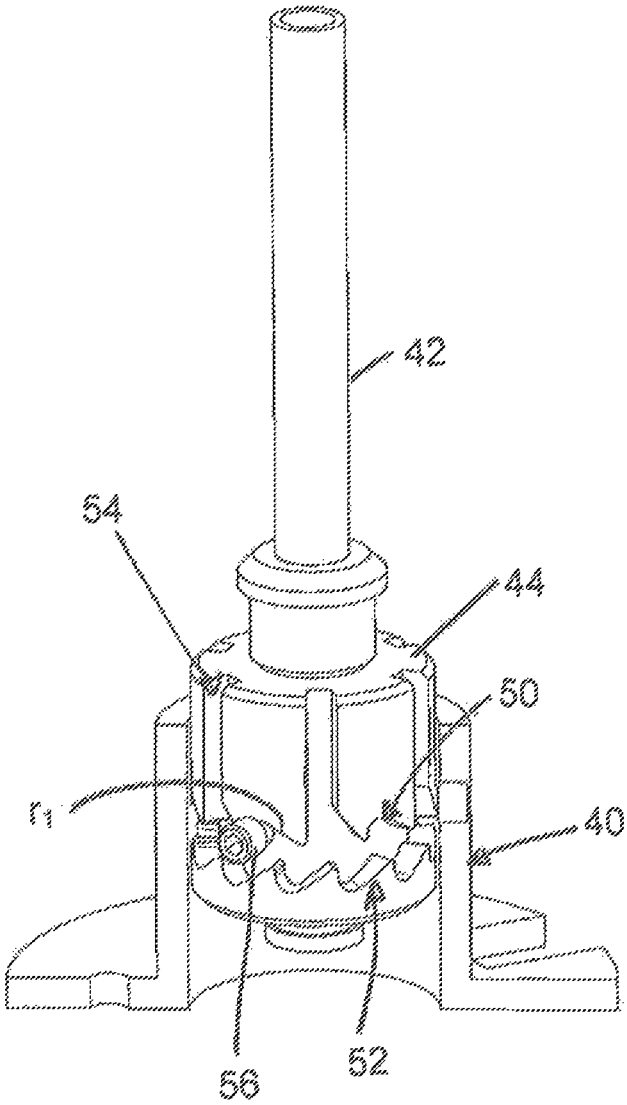

FIG. 8 shows the static or resting mode following a previous fastener insertion and firing cycle. In this mode, the fastener guide 42 under its axial spring bias is in a forward axial position relative to the outer housing 40 as is the cam body 44. In this mode, the cam pin 56 is resting in an arcuate valley in the lower cam track 52. The engagement of the pin 56 in this valley locates the cam body 44 in a predetermined angular and axial position.

When the next fastener has been applied to the end of the fastener guide 42 as previously described and its tubular stem is inserted into the insulation batt by manual force applied by the operator to the tool, if the force required for insertion/penetration exceeds the forward spring loading on the fastener guide, the fastener guide and cam body will displace axially inwardly. This inwards displacement causes a ramped section $r_1$ on the upper cam track 50 to engage the cam pin whereby the cam body will be indexed angularly until the cam pin seats in an arcuate crest at the upper end of that ramped portion thereby limiting further rotation at this stage. This is the condition shown in FIG. 9. In this mode it will be understood that the engagement of the cam pin within the crest of the upper track will lock the cam body 44 and thereby the fastener guide 42 against further inwards movement under the forces needed to penetrate the batt and, as a result, cocking of the tool cannot take place. The forces continue to be applied by the operator until the tip of the fastener has fully penetrated the batt and is in engagement with the underlying substrate. Although the fastener is now properly positioned so that the tool can safely be fired, firing cannot occur because the tool has not been cocked and cannot be cocked due to the locking effect provided by the cam pin in the upper crest. It is to be noted that if the force required to penetrate the batt is relatively low (as may arise with some batts of low density), the actions just described will occur when the tip of the fastener has fully penetrated the batt and has engaged the underlying substrate.

Figure 10:
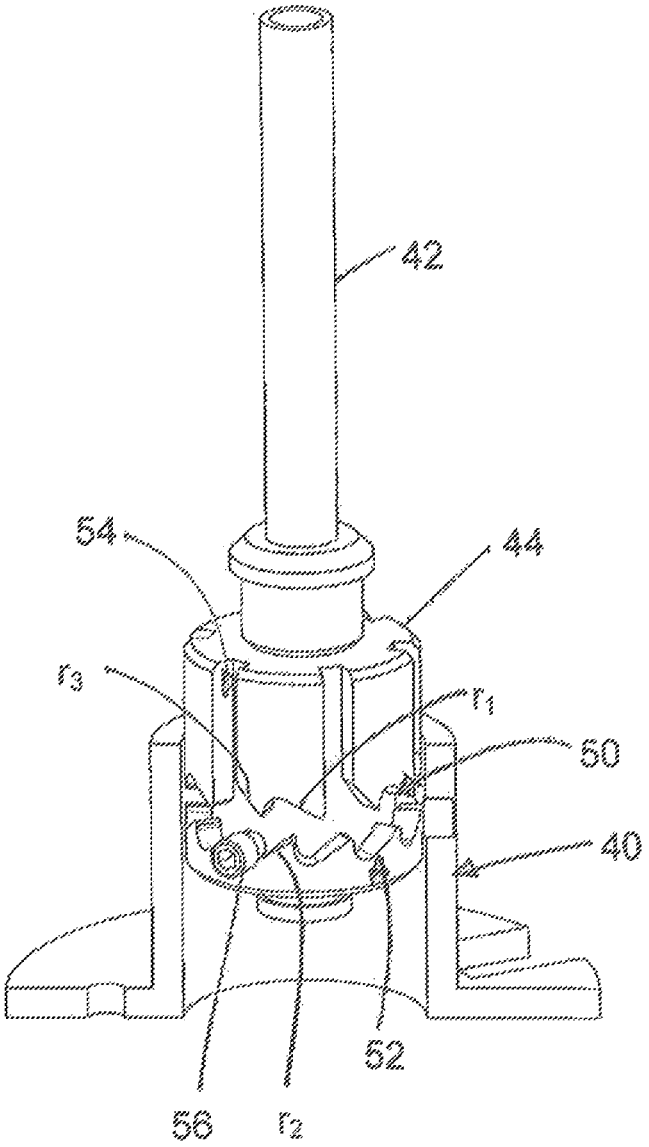
Figure 11:
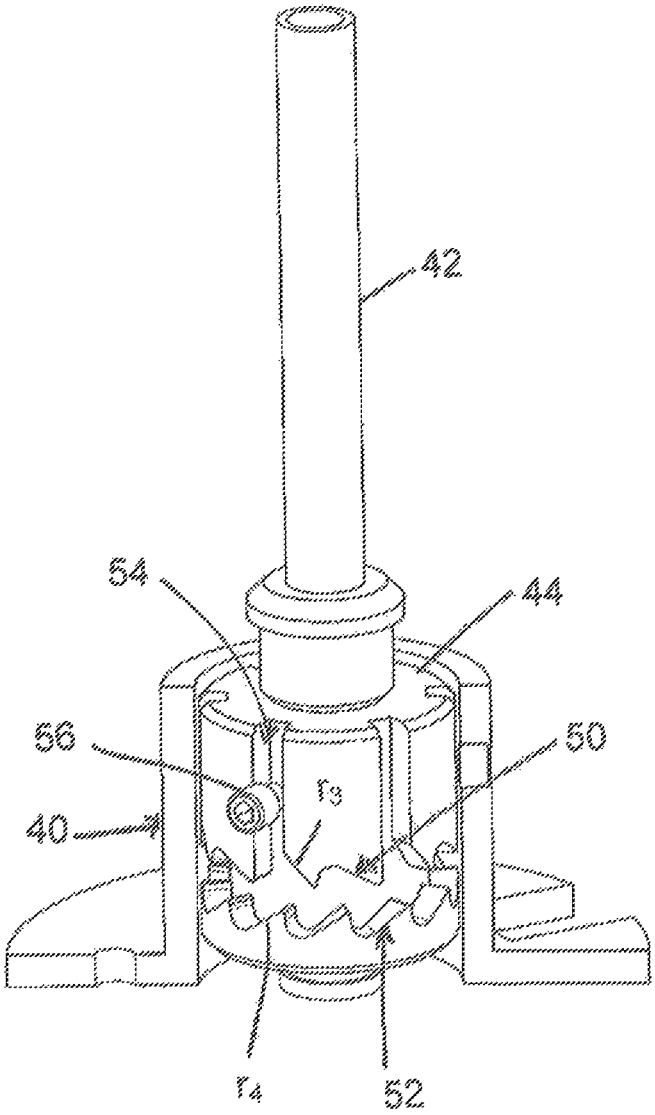

In order now to cock the tool in preparation for firing, the operator releases the forward pressure on the tool body. As the tool body draws rearwardly, the cam pin will engage the next ramped section $r_2$ on the lower cam track 52 and will index the cam body until the cam pin rests in the adjacent arcuate valley associated with that segment of the lower track. This is shown in FIG. 10 and it should be noted that this valley is the adjacent valley to that which the cam pin occupied in FIG. 8. If the tool body is now pushed forwardly, the cam pin 56 will engage the opposite ramped section $r_3$ of the upper cam track 50. This ramped section leads directly into the adjacent axial cam track 54 and forwards pressure applied by the operator will, by interaction between the cam pin 56 and ramped section $r_3$, index the cam body to a position at which the cam pin can enter the axial cam track 54. When this occurs, the tool body can then be pushed forwardly relative to the cam body and fastener guide by an extent sufficient to cock the tool and thereby enable firing. This is the condition shown in FIG. 11. When, after firing, the forward pressure is released, the fastener guide and cam body are able to move forwardly relative to the cam pin whereby the cam pin exits the rear end of the axial cam track 54 and engages the opposite ramped section $r_4$ of the lower cam track and indexes the cam body into the resting or static mode shown in FIG. 8.

An alternative embodiment (not shown) of somewhat simpler construction involves the use of a torsionally-biased twist locking mechanism which, in a normal condition, locks the fastener guide against axial movement relative to the housing 40 thereby preventing cocking of the tool during insertion and penetration of the insulation batt. To facilitate cocking when insertion has been completed, the tool body and thereby the housing is rotated through a predetermined angle relative to the fastener guide and this has the effect of releasing the lock between the fastener guide and housing so as to then permit the tool body to be pressed forwards (relative to the fastener guide) sufficiently to permit cocking. This effect can be achieved by means of a cam pin carried by a housing (similar to the housing 40) engaging in a simple cam track formed on the fastener guide, with a torsional bias being provided between the fastener guide and housing to ensure that the fastener guide will return angularly to its locked position after firing when the forward pressure on the tool body is released. This embodiment relies on the inserted fastener having sufficient torsional anchorage within the bat to ensure that the tool body is able to rotate relative to the fastener guide which is restrained against rotation by its attachment to the fastener itself. While sufficient torsional anchorage of the fastener may occur when it is used with relatively dense batts, this may not arise with foam batts of reduced density or batts made of glass wool. Accordingly while this embodiment does have utility, its utility is restricted principally to use with foam and other batts of relatively high density. While such batts will be used in many commercial situations, nevertheless the previous embodiment is preferred as it is suitable for use with all types of batts, irrespective of their density as the angular indexing system used in that embodiment does not rely on angular retention of the fastener guide for its operation.

The embodiments thus far described basically involve the use of an attachment which provide a replacement fastener guide and associated locking system so as to prevent cocking of the tool when pushing the fastener through insulation or other cladding. While the attachments are applicable to p.a. tools, gas tools, or air tools, in the case of a gas tool the required effect can alternatively be achieved through modifications to the control circuitry of the tool rather than through a mechanical locking system as occurs in the embodiments described thus far. In particular, in a typical gas tool cocking of the tool by retraction of the fastener guide into the body of the tool as previously described actuates a limit switch which, through appropriate control circuitry, initiates injection of fuel and operation of a fan to mix the fuel with air so as to permit firing of the tool by operation of the trigger. However by modifying the control circuitry, initiation of the combustion process in the manner described can be achieved at every alternate (second) actuation of the limit switch whereby on a first actuation which occurs when pushing the fastener through the cladding, cocking of the tool by initiation of the combustion process will not take place. In order to cock the tool in preparation for firing, the operator releases the forward pressure on the tool body and then reapplies the pressure sufficiently to cause a second actuation of the limit switch which will then result in initiation of the combustion process.

In this version the control circuitry can be configured to permit, selectively, cocking of the tool at alternate actuations of the limit switch just described, or cocking at each actuation when regular operation of the tool is required.

It is envisaged that in other tools modifications to directly inhibit/disable the firing process could be made to achieve the required effect instead of mechanically locking the fastener guide as in the embodiments described in detail herein.

The embodiments have been described by way of example only and modifications are possible within the scope of the invention.

The invention claimed is:

1. A tool for driving a fastener pin into a substrate to secure a fastener body to the substrate for fixing insulation or other cladding, the tool being of the type comprising a fastener guide and a driving piston driven along the fastener guide by gas pressure to engage and drive the pin, the fastener guide being displaceable axially inwardly relative to the body of the tool in order to cock the tool for firing of the driving piston, wherein the tool comprises means for enabling the tool to push the fastener body through insulation or other cladding into engagement with the underlying substrate without putting the tool into a condition in which firing can occur, the tool being thereafter able to be put into a condition to permit firing to take place.

2. A tool according to claim 1, wherein the means for enabling the tool to push the fastener body through the insulation or other cladding without putting the tool into a condition in which firing can occur comprises a releasable lock for preventing cocking of the tool during that action.

3. A tool according to claim 2, wherein the lock is operable to prevent displacement of the fastener guide axially inwardly relative to the tool body at least by an extent sufficient to permit cocking.

4. A tool according to claim 2 wherein the tool is operable to be put into a condition in which firing can occur following engagement of the fastener body with the underlying substrate, by releasing axial load applied by an operator to the tool body to push the fastener body through the insulation or other cladding and then re-applying the axial load to the tool body whereby to cause cocking of the tool.

5. A tool according to claim 4, wherein release of the axial load on the tool body following engagement of the fastener body with the underlying substrate causes release of the lock.

6. A tool according to claim 1, wherein the means for enabling the tool to push the fastener body through the insulation or other cladding without putting the tool into a condition in which firing can occur comprises means for preventing initiation of firing of the tool during that action.

7. A tool according to claim 1, wherein the tool is a gas tool having control circuitry operable to initiate the gas combustion process in response to inwards displacement of the fastener guide, the circuitry being inoperative to initiate the combustion process during a first relative inwards displacement of the fastener guide occurring while pushing the fastener body into engagement with the underlying substrate, the circuitry being then operative to initiate the combustion process in response to a second relative inwards displacement of the fastener guide.

8. A tool according to claim 1, wherein the tool is a gas tool having control circuitry operable to initiate the gas combustion process in response to inwards displacement of the fastener guide, the circuitry being inoperative to initiate the combustion process during a first relative inwards displacement of the fastener guide occurring while pushing the fastener body into engagement with the underlying substrate, the circuitry being then operative to initiate the combustion process in response to a second relative inwards displacement of the fastener guide.

9. A tool for driving a fastener pin into a substrate to secure a fastener body to the substrate for fixing insulation or other cladding, the tool being of the type comprising a fastener guide and a driving piston driven along the fastener guide by gas pressure to engage and drive the fastener, the fastener guide being displaceable axially inwardly relative to the body of the tool in order to cock the tool for firing of the driving piston, wherein the tool comprises means for locking the fastener guide against axial displacement relative to the tool body sufficient to prevent cocking to thereby permit the tool to push the fastener body through insulation or other cladding into engagement with the underlying substrate without cocking the tool, the means for locking being thereafter releasable to permit cocking to take place.

10. A tool according to claim 9, wherein release of the lock against axial displacement occurs in response to release of axial load applied by an operator to the tool body to push the fastener body through the insulation or other cladding whereby when axial load is next applied the tool can be cocked.

11. A tool according to claim 10, wherein the fastener guide is associated with a cam system which causes alternative locking and release in different angular positions.

12. A tool according to claim 11, wherein the cam system comprises a rotatable cam body carried by the fastener guide and having cam tracks which co-operate with a fixed cam member whereby the cam is successively indexed to locking and release positions for the fastener guide in response to axial load applied to the tool body by the operator.

13. A tool according to claim 9, wherein the lock against axial displacement is releasable by deliberate intervention of the operator after insertion of the fastener body through the insulation or other cladding.

14. A tool according to claim 9, wherein the means for locking is a cam system.

15. A tool according to claim 14, wherein the tool is configured such that release of the lock against axial displacement occurs in response to release of axial load applied by an operator to the tool body to push the fastener body through the insulation or other cladding whereby when axial load is next applied the tool can be cocked.

16. A tool according to claim 15, wherein the fastener guide is associated with the cam system which causes alternative locking and release in different angular positions.

17. A tool according to claim 16, wherein the cam system comprises a rotatable cam body carried by the fastener guide and having cam tracks which co-operate with a fixed cam member whereby the cam is successively indexed to locking and release positions for the fastener guide in response to axial load applied to the tool body by the operator.

18. A tool according to claim 14, wherein the tool is configured such that the lock against axial displacement is releasable by deliberate intervention of the operator after insertion of the fastener body through the insulation or other cladding.

19. A tool for driving a fastener pin into a substrate to secure a fastener body to the substrate for fixing insulation or other cladding, the tool being of the type comprising a fastener guide and a driving piston driven along the fastener guide by gas pressure to engage and drive the pin, the fastener guide being displaceable axially inwardly relative to the body of the tool in order to cock the tool for firing of the driving piston, wherein the tool includes a first component configured to enabling the tool to push the fastener body through insulation or other cladding into engagement with the underlying substrate without putting the tool into a condition in which firing can occur, the tool being thereafter able to be put into a condition to permit firing to take place.

20. A tool according to claim 19, wherein the first component is a releasable lock.

21. A tool according to claim 19, wherein the first component is a releasable lock configured to prevent cocking of the tool during the pushing of the fastener body through insulation or other cladding into engagement with the underlying substrate without putting the tool into a condition in which firing can occur.

22. A tool according to claim 21, wherein the lock is configured to prevent displacement of the fastener guide axially inwardly relative to the tool body at least by an extent sufficient to permit cocking.

23. A tool according to claim 21 wherein the tool is configured to be put into a condition in which firing can occur following engagement of the fastener body with the underlying substrate, by releasing axial load applied by an operator to the tool body to push the fastener body through the insulation or other cladding and then re-applying the axial load to the tool body whereby to cause cocking of the tool.

24. A tool according to claim 23 wherein the tool is configured such that the release of the axial load on the tool body following engagement of the fastener body with the underlying substrate causes release of the lock.

25. A tool according to claim 19, wherein the first component is configured to prevent initiation of firing of the tool during the pushing of the fastener body through insulation or other cladding into engagement with the underlying substrate without putting the tool into a condition in which firing can occur.

* * * * *

UNITED STATES PATENT AND TRADEMARK OFFICE

CERTIFICATE OF CORRECTION

PATENT NO. : 8,800,836 B2
APPLICATION NO. : 13/129069
DATED : August 12, 2014
INVENTOR(S) : Scott et al.

It is certified that error appears in the above-identified patent and that said Letters Patent is hereby corrected as shown below:

On the title page item (75), line 3, "Victoria (AD)" should read -- Victoria (AU) --

Signed and Sealed this
Twenty-third Day of December, 2014

Michelle K. Lee

Michelle K. Lee
*Deputy Director of the United States Patent and Trademark Office*